US006537036B1

(12) United States Patent
Broerman et al.

(10) Patent No.: US 6,537,036 B1
(45) Date of Patent: Mar. 25, 2003

(54) FLOW AMPLIFYING PUMP APPARATUS

(75) Inventors: Steven Broerman, Mason, OH (US); Aaron V. Monje, Chicago, IL (US)

(73) Assignee: Illinois Tool Works, Glenview, IL (US)

( * ) Notice: Subject to any disclaimer, the term of this patent is extended or adjusted under 35 U.S.C. 154(b) by 0 days.

(21) Appl. No.: 09/952,001

(22) Filed: Sep. 13, 2001

(51) Int. Cl.[7] ..... F04F 5/48

(52) U.S. Cl. ..... 417/182.5; 417/185; 417/190; 417/198

(58) Field of Search ..... 417/182.5, 185, 417/190, 197, 198; 137/206

(56) References Cited

U.S. PATENT DOCUMENTS 35,575 A * 6/1862 Millholland ..... 417/198
2,946,293 A * 7/1960 Henshaw ..... 417/183
4,046,492 A 9/1977 Inglis
4,195,780 A 4/1980 Inglis
4,200,425 A * 4/1980 Teodorescu et al. ..... 417/178
5,402,938 A 4/1995 Sweeney
6,354,371 B1 * 3/2002 O'Blanc ..... 166/154

OTHER PUBLICATIONS

Drawing No. 2104–2 showing ITW Vortec Mode 2104.

* cited by examiner

*Primary Examiner*—Charles G. Freay

(57) ABSTRACT

A flow amplifying pump apparatus includes a body member that defines a flow passageway and a compressed air inlet. The body member includes a main segment and an insert segment which extends into a container and rotates relative to the main segment. A cover member which lies releasably secured to the body member supports a plug assembly. The plug assembly includes a plunger that defines a groove for cooperating with a protuberance in the cover member to guide the plunger along a predetermined, substantially linear path.

26 Claims, 5 Drawing Sheets

35
35
V
F
35
60

65
68
62
60
69
33
71
66
70
32
72
59
47
56
39
47a
41
47
57
F
36
38
53
P
31
55
40
35
S 54
7
7
V
42
43
37
C
44
51
51
D
48
45
34
52
49
50

58
53
P
54
55

FLOW AMPLIFYING PUMP APPARATUS

BACKGROUND OF THE INVENTION

1. Field of the Invention

The present invention relates generally to a pump apparatus powered by compressed air and used to fill or evacuate containers such as fifty-five gallon drums, and more particularly to a pump apparatus with a fluid amplifier that creates a vacuum inside the container to fill the container or pressurizes the container to evacuate it.

2. Description of Related Art

A variety of known apparatus can fill containers such as fifty-five gallon and thirty gallon drums with liquid and discharge liquid from such containers. These devices either create a vacuum inside the container to facilitate the filling of the container, or they pressurize the container to facilitate evacuation. Some of these devices, known as "drum pumps" have a large number of industrial applications, including the transport of metal cutting fluids, paints, non-flammable solvents, and similar materials in and out of fifty-five gallon drums.

The prior drum pumps typically include an air flow amplifier assembly such as the one described in U.S. Pat. No. 4,046,492. This assembly when used in a "drum pump" type application receives compressed air and creates a vacuum in a drum during a filling mode of operation. It also pressurizes the container during a discharging mode of operation. In the fill mode of operation, a suction end of the amplifier, which extends into the drum, pulls air out of the drum and liquids into the drum through a conveying hose. A float valve assembly lies connected to the suction end of the amplifier. Rising fluid raises a float in the float valve assembly which stops the vacuum flow between the pump and the drum, preventing over-filling of the drum.

In the discharge mode, a plug assembly of this prior pump assembly closes the air flow amplifier, forcing the compressed air to flow directly into the drum. The compressed air then pressurizes the drum and forces the liquid in the drum out through the conveying hose. A pressure relief valve prevents over-pressurization of the container and any damage to the drum by allowing the compressed air to discharge from the drum.

One specific example of a prior drum pump apparatus 20, shown in FIGS. 8–12, includes a body 21 with an air flow amplifier 22, a compressed air inlet 23, a float valve assembly 24, and a plug assembly 25 having a pressure relief valve 26 and a handle 27. The handle 27 lies threadably mounted to the body 21 and allows an operator to thread it between a position in which the plug assembly closes the air flow amplifier and a position in which the plug assembly leaves the air flow amplifier open.

The pump apparatus shown in FIGS. 8–12 suffers a number of disadvantages. First, when installed on a drum or other container, it does not allow easy adjustment of the position of the compressed air inlet. When moving it from drum to drum, it requires disconnecting it from the compressed air conduit or hose. In addition, the adjustment of the plug handle between the fill and discharge modes requires multiple rotations of the handle. It does not allow quick and easy placement of the plug. Also, this pump apparatus, when placed in the fill mode, discharges compressed air at a substantial distance from the top of the drum with which it cooperates; resulting in splashing of any liquid that collects on top of the drum. Finally, the construction of this prior pump apparatus requires expensive and precisely manufactured components and complex and costly fabrication procedures.

The pump apparatus of the present invention avoids the disadvantages of the prior art pumps. It has a simple construction which minimizes the expense of manufacture and assembly. It allows easy adjustment of the position of the compressed air inlet after installation on a corresponding drum. It allows fast and easy adjustment of the plug to initiate the fill and discharge modes. And, it discharges compressed air proximate the top of the drum to minimize splashing and spilling.

SUMMARY OF THE INVENTION

In accordance with one embodiment of the present invention, a pump apparatus includes a body member, which defines an air flow passageway for receiving compressed air and for amplifying its volume (flow), and a compressed air inlet which communicates with the passageway. The body member includes a main segment and an insert segment that extends into a container. The insert segment rotates relative to the main segment.

A cover member lies over the body member, a spaced distance outwardly of the body member. A plug assembly lies mounted on the cover member proximate the body member. The plug assembly closes and opens one end of the passageway in the body member. It includes a plunger disposed in sliding engagement with the cover member. This plunger has a gripping portion at one end and a valve assembly at an opposite end. The plunger defines a groove which cooperates with a protrusion in the cover member to guide the plunger along a substantially linear path.

The cover member lies releasably secured to the body member by at least one securing member. The securing member extends through the main segment of the body member and into a groove in the insert segment to pivotally connect the main segment to the insert segment. The pump apparatus of the present invention may include more than one securing member, e.g., three shoulder screws.

BRIEF DESCRIPTION OF THE DRAWINGS

For a more complete understanding of this invention, one should now refer to the embodiment illustrated in greater detail in the accompanying drawings and described below by way of an example of the invention. In the drawings.

While the following disclosure describes the invention in connection with one embodiment, one should understand that the invention is not limited to this embodiment. Furthermore, one should understand that the drawings are not to scale and that graphic symbols, diagrammatic representations, and fragmentary views, in part, may illustrate the embodiment. In certain instances, the disclosure may not include details which are not necessary for an understanding of the present invention such as conventional details of fabrication and assembly.

DETAILED DESCRIPTION OF THE DRAWINGS

Figure 1:
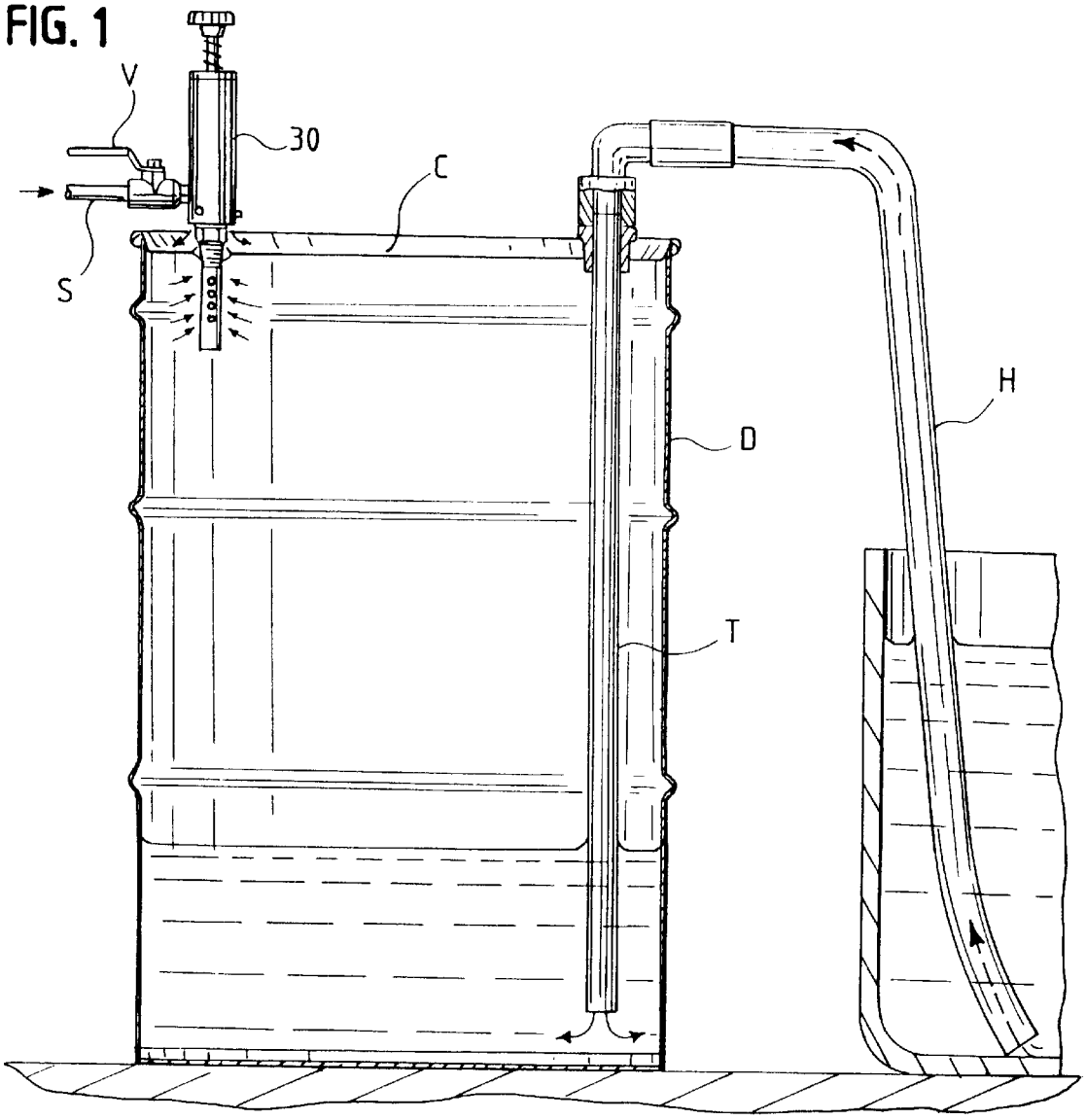
FIG. 1 is a front elevation view of the pump apparatus of the present invention installed on a fifty-five gallon drum, showing the drum as it fills with liquid.
Figure 2:
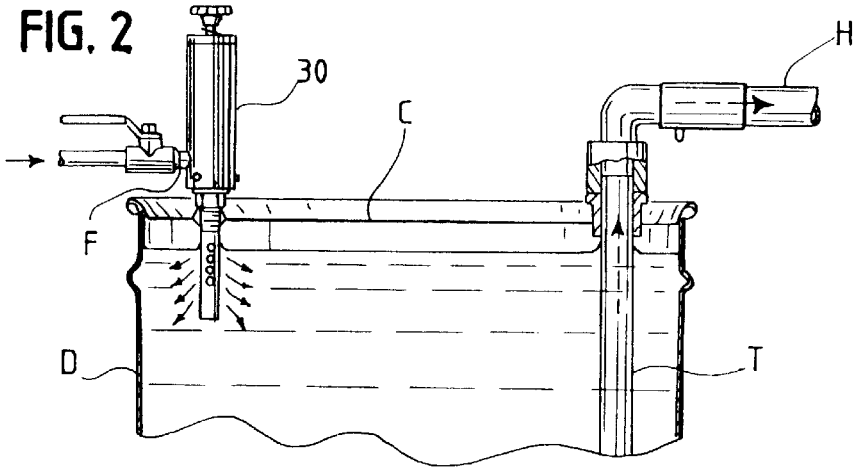
FIG. 2 is the top portion of the front elevation view of FIG. 1, showing the drum as liquid discharges from it.

Turning now to the drawings and referring specifically to FIGS. 1 and 2, a pump apparatus of the present invention 30 lies detachably secured to a top cover C of a fifty-five gallon drum D. The pump apparatus 30 extends into the drum D through an opening in the cover C. It receives compressed air from a supply conduit S, including a valve V for stopping the flow of compressed air and a fitting F for connecting the conduit S to the apparatus 30. It uses the compressed air to generate a vacuum in the drum D or to pressurize the drum.

In the fill mode of operation, shown in FIG. 1, the pump apparatus 30 evacuates air from the drum D to generate the vacuum that facilitates filling of the drum with liquid. The liquid flows into the drum D through a conveying hose H and a tube T that extends into the drum, proximate the bottom, through a second, larger opening in the cover C. In the discharge mode, shown in FIG. 2, the pump apparatus 30 directs compressed air into the drum D to pressurize it and push the liquid out of the drum through the tube T and the hose H, as shown in FIG. 2.

The pump apparatus of the present invention 30 generally includes a body member 31, a cover member 32, a plug assembly 33 and a float assembly 34. (See FIG. 3). (Apart from a number of exceptions indicated below, these components are made of aluminum, steel or any other materials of high strength and rigidity.) The cover member 32 lies over the body member 31 releasably secured (with three screws 35) to the body member 31 a spaced distance outwardly of the body member. The float assembly 34 lies secured to the body member 31 at one end; and the plug assembly 33 lies proximate an opposite end of the body member 31 supported by the cover member 32.

The body member 31 comprises a main segment 36 and an insert segment 37 rotatably mounted to the main segment, as described below. The main segment 36 is a two-piece structure with a body piece 38 and a flow amplifier piece 39 which lies threaded or otherwise secured to the body piece 38. The body piece 38 defines a circular, irregular passageway 40 which extends along the length of the body piece 38 and receives the insert segment 37 at one end and the flow amplifier piece 39 at an opposite end. It also defines a compressed air inlet 41 which receives the fitting F of the compressed air supply conduit S, communicates with the passageway 40 proximate the middle of the body piece 38, and lies generally transversely of the passageway 40.

A first end portion of the insert segment 37 extends into the passageway 40 while the opposite end portion extends into the drum D. The first end portion has the size and round shape which allows the segment 37 to rotate within the passageway 40. An annular groove 42 in this first end portion of the segment 37 receives the distal ends of the screws 35 which secure the cover member 32 to the body piece 38 and the body piece 38 to the insert segment 37. The screws 35 and the groove 42 cooperate to provide a pivot connection between the segment 37 and the body piece 38. (See FIG. 7). An o-ring 43 made out of rubber or any other suitable resilient material seals the pathway between the passageway 40 and the outer surface of the insert segment 37, while a threaded portion 44 of the outer surface of the segment 37 cooperates with the threaded surface of the opening in the drum cover C to releasably secure the pump apparatus 30 to the drum D.

The float assembly 34 includes a round tube 45 having one end press fit or otherwise secured into a bore 46 of the insert segment 37. This tube defines openings 48 which allow air to move through the tube and the bore 46. It contains a float 49 made out of plastic, cork, or any other suitable material that floats in liquids. A retaining ring 50 which lies in a groove at the distal end of the tube 46 prevents the float 49 from dropping out of the tube, and a step 51 of the bore 46 stops the float 49 from rising above a predetermined limit. Also, an o-ring 52 formed of rubber or any other suitable resilient material disposed around the top end of the float 49 helps seal the bore 46 and prevents liquid from flowing into the bore 46 when the drum D has filled and the float 49 has moved to its uppermost position.

An inner end portion 53 of the flow amplifier piece 39 cooperates with the walls of the passageway 40 at the compressed air inlet 41 to form an annular cavity 54 and an annular slit 55. The cavity 54 connects the inlet 41 with the slit 55, while the slit 55 communicates with an amplifier bore 56 defined by the piece 39. This bore 56 has frusto-conical end portions and a middle portion of constant diameter. (See U.S. Pat. No. 4,046,492 issued to Leslie R. Inglis on Sep. 6, 1977.) A generally Y-shaped spacer 47 sandwiched between the amplifier piece 39 and the body piece 38 helps maintain the spacing between the body member 31 and the cover member 32, defining an annular discharge cavity 57 between these two members. (See FIG. 4). And, a shim 58 disposed between the pieces 38 and 39 controls the width of the slit 55. An annular rubber spacer 47*a* minimizes vibration of the spacer 47. Finally, a resilient o-ring 59 disposed between the amplifier piece 39 and the body piece 38 seals any flow path that may develop between these two pieces.

The amplifier bore 56 of the amplifier piece 39, the passageway 40 of the body piece 38 and the bore 46 of the insert segment 37 combine to form a flow path P through the body member 31. The compressed air that meters through the slit 55 increases in velocity through the slit and creates a vacuum in the passageways 40 and 46. This vacuum creates entrained airflow through the passageways 40 and 46. This entrained flow results in the rapid evacuation of air from the inside fo the drum D and formation of a vacuum within the drum.

The cover member 32 includes a circular tube segment 60 and a round cap piece 61 press fit or otherwise secured to a top end of the tube segment 60, opposite the end that receives the body member 31. At this end, the cap piece 61 supports the plug assembly 33; and it supports a set screw 62 that cooperates with the plug assembly. At the opposite end, the tube segment 60 defines an opening 63 in substantial registry with the inlet 41 so that the fitting F may extend through the cover member 32 and into the body member 31.

Figures 3, 4, 5:
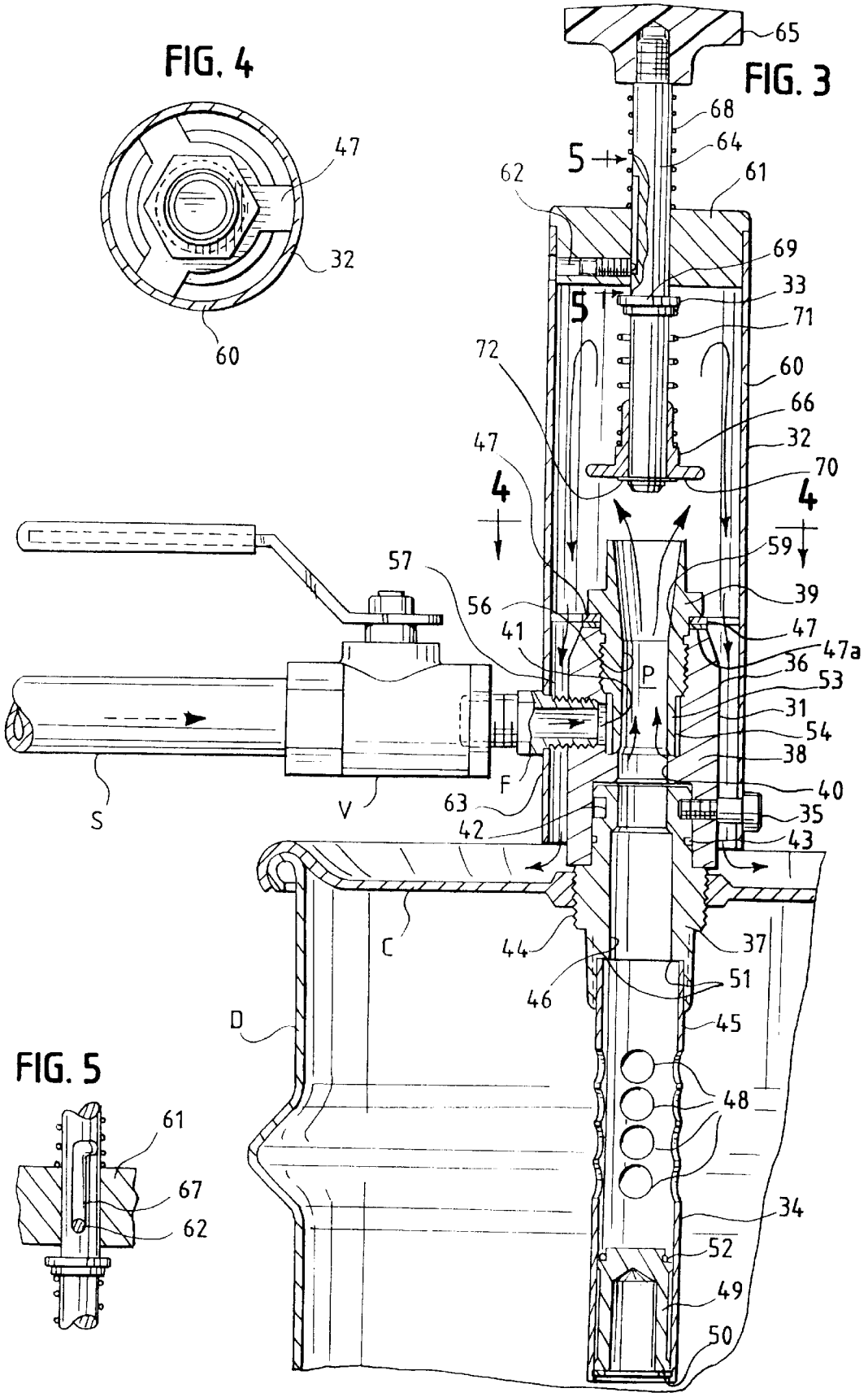
FIG. 3 is a sectional view of the pump apparatus of the present invention, showing the apparatus in the filling mode.
FIG. 4 is a sectional view taken along line 4—4 in FIG. 3.
FIG. 5 is a sectional view taken along line 5—5 in FIG. 3.

As shown in FIG. 3, the cover member 32 extends proximate the top cover of the drum D, minimizing any splashing that may occur when the amplified air flows out of the pump apparatus through the annular cavity 57.

The plug assembly 33 comprises a rod-like plunger 64 supporting a handle 65 at one end and a pressure relief valve 66 at the opposite end. This plunger 64 defines a groove 67 which cooperates with the distal end of the set screw 62 to guide the plunger 64 along a substantially linear path. (See FIG. 5). The small, transverse portion of the generally longitudinal groove locks the plunger 64 in the lowered position shown in FIG. 6. A compression spring 68 disposed between the handle 65 and the cap piece 61 biases the plunger 64 to the raised position shown in FIG. 3, while a shoulder 69 acts as a stop to prevent the plunger from moving beyond that position.

The pressure relief valve 66 opens and closes the flow path P at the top end of the amplifier piece 39. It includes a poppet piece 70 slidably mounted onto the plunger 64 and a compression spring 71 which biases the poppet piece 70 to the position shown in FIG. 3. A retaining ring 72 stops the poppet piece 70 at this position.

When an operator places the plug assembly 33 in the position shown in FIG. 3, the flow path P lies open; and the pump apparatus 30 assumes the fill mode. In this mode, compressed air flows into the amplifier piece 39; and its flow increases, pulling air out of the drum through the path P into the cover member 32 and out of the apparatus through the annular cavity 57. This creates a vacuum in the drum and facilitates the flow of liquid into it.

Figures 6, 6A, 7:
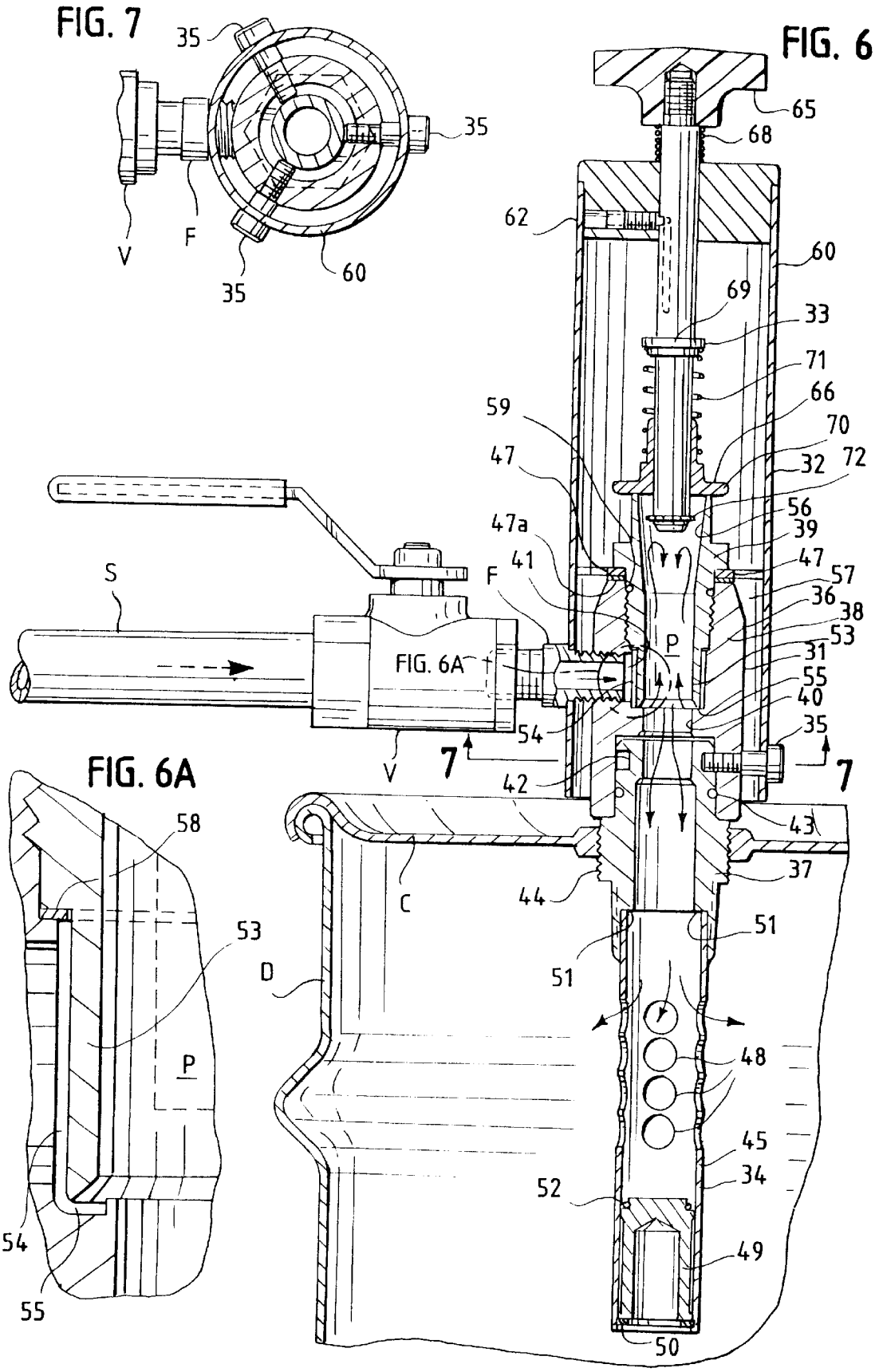
FIG. 6 is the sectional view of FIG. 3, showing the pump apparatus of the present invention in the discharge mode.
FIG. 6A is a sectional view detail in FIG. 6.
FIG. 7 is a sectional view taken along line 7—7 in FIG. 6.
Figure 8:
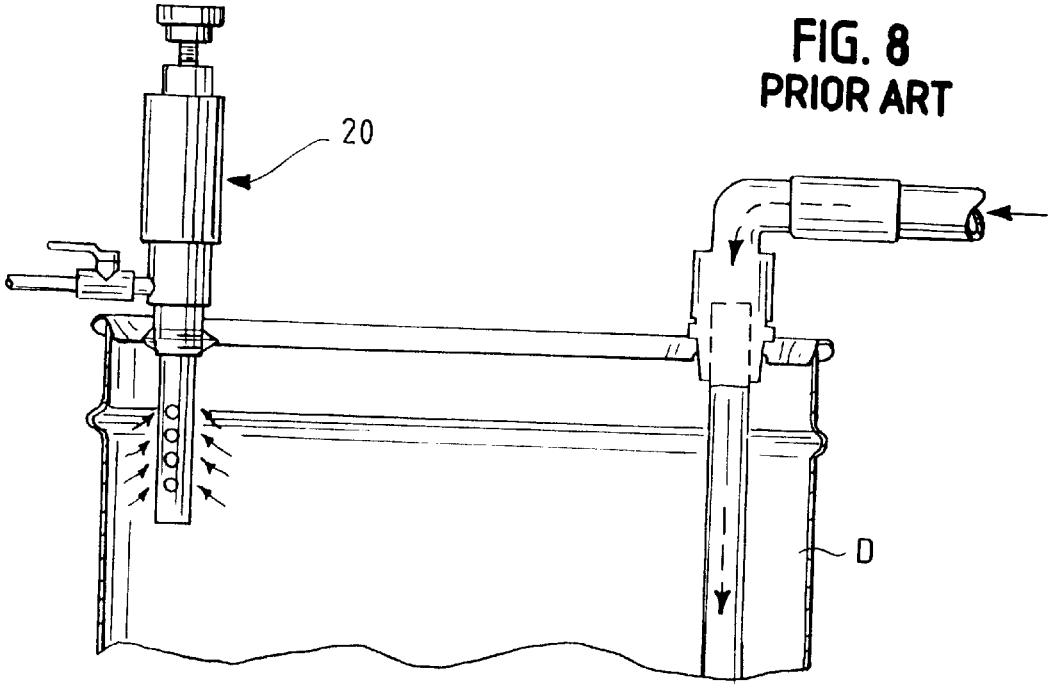
FIG. 8 PRIOR ART
FIG. 8 is a front elevation view of a prior art pump apparatus installed on a fifty-five gallon drum, showing the drum as it fills with liquid.
Figure 10:
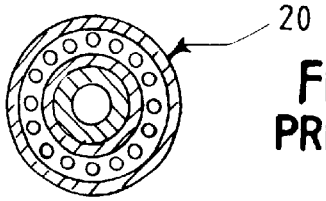
FIG. 10 PRIOR ART
FIG. 10 is a sectional view taken along line 10—10 in FIG. 9.
Figure 9:
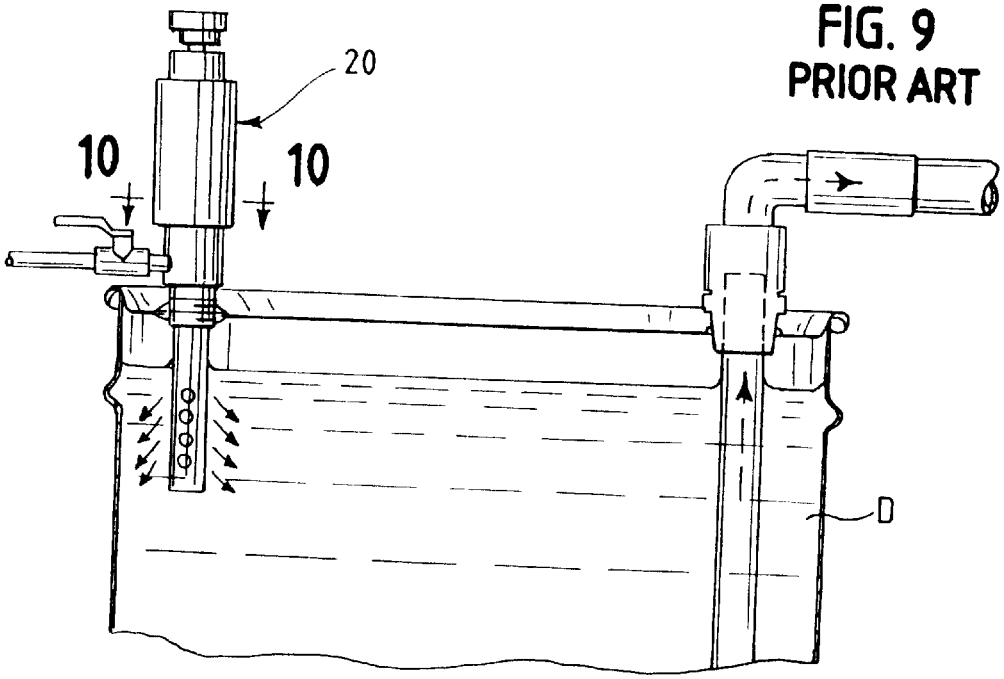
FIG. 9 PRIOR ART
FIG. 9 is the front elevation view of FIG. 8, showing the drum as liquid discharges from it.
Figure 11:
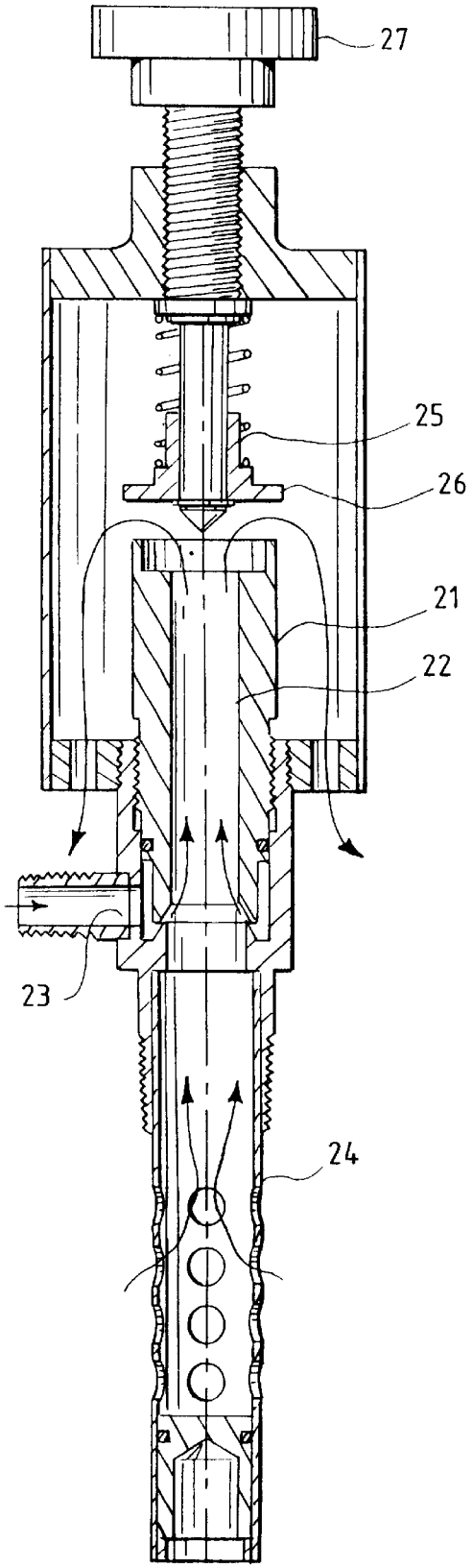
FIG. 11 PRIOR ART
FIG. 11 is a sectional view of the prior art pump apparatus of FIGS. 8–10, showing the apparatus in the filling mode.
Figure 12:
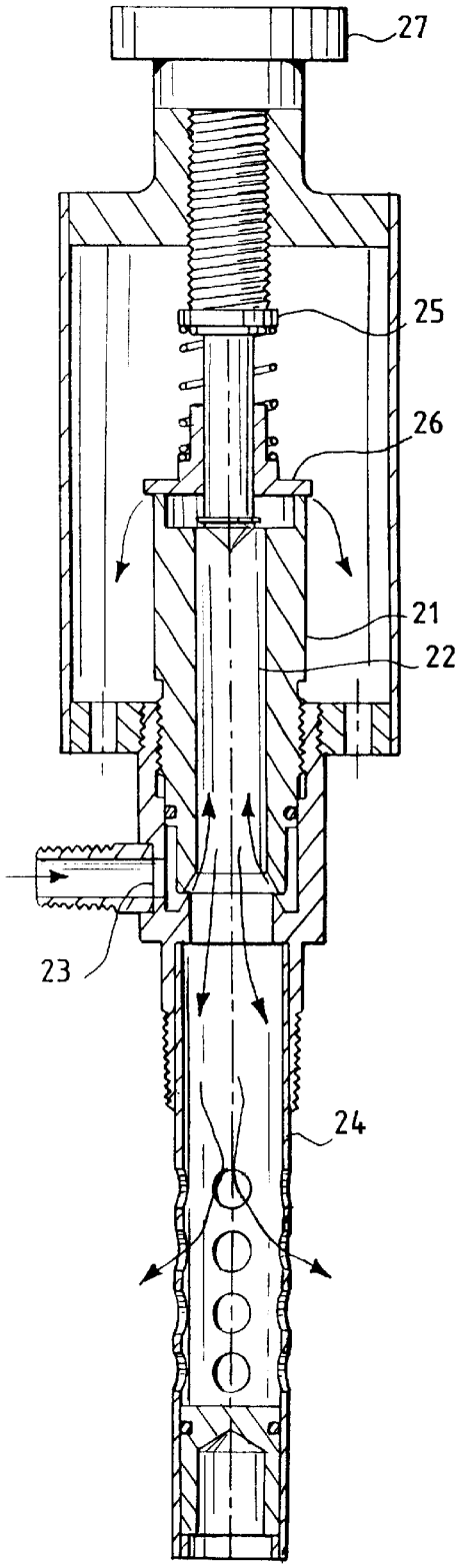
FIG. 12 PRIOR ART
FIG. 12 is the sectional view of FIG. 11, showing the prior art apparatus in the discharge mode.

When an operator places the plug assembly in the position shown in FIG. 6, the poppet piece 70 closes the path P and the compressed air flowing into the body member 31 flows downwardly through the insert segment 37, through the float assembly 34 and into the drum D, increasing the pressure in the drum. This increased pressure pushes liquid out of the drum and facilitates its evacuation. If the pressure in the drum rises beyond a predetermined level, it overcomes the force of the compression spring 71 and raises the poppet piece 70 to reduce the pressure in the drum.

While the above description and the drawings disclose and illustrate one embodiment, one should understand, of course, that the invention is not limited to this embodiment. Those skilled in the art to which the invention pertains may make modifications and other embodiments employing the principles of this invention, particularly upon considering the foregoing teachings. Therefore, by the appended claims, the applicants intend to cover any modifications and other embodiments as incorporate those features which constitute the essential features of this invention.

What is claimed is:

1. A pump apparatus comprising: a body member defining an air flow passageway for receiving compressed air and amplifying its velocity and a compressed air inlet in communication with the air flow passageway, the body member including a main segment and an insert segment for inserting into a container, the insert segment being rotatable relative to the main segment without advancing inwardly or outwardly of the main segment; and a cover member disposed over the body member, a spaced distance outwardly of the body member.

2. The pump apparatus of claim 1, further comprising a plug assembly mounted on the cover member and disposed proximate the body member, the plug assembly closing and opening one end of the passageway of the body member.

3. The pump apparatus of claim 2, wherein the plug assembly includes a plunger in sliding engagement with the cover member, the plunger having a gripping portion at one end and a valve assembly at an opposite end, the plunger also defining a groove and the cover member including a protrusion that cooperates with the groove to limit the plunger movement along a substantially linear path.

4. The pump apparatus of claim 2, wherein the cover member is releasably secured to the body member by at least one securing member, the securing member extending through the main segment of the body member and into a groove in the insert segment to pivotally connect the main segment to the insert segment.

5. The pump apparatus of claim 4, wherein three securing members releasably secure the cover member to the body member, the three securing members being screws.

6. The pump apparatus of claim 2, wherein the cover member defines an opening for placement in substantial registry with the compressed air inlet of the body member, the opening receiving a fitting of a compressed air conduit, the fitting extending into the inlet of the body member.

7. A pump apparatus comprising: a body member defining an air flow passageway for receiving compressed air and amplifying its velocity and a compressed air inlet in communication with the air flow passageway, the body member including a main segment and an insert segment for inserting into a container, the insert segment being rotatable relative to the main segment without advancing inwardly or outwardly of the main segment, and a float assembly secured to the insert segment.

8. A pump apparatus comprising: a body member defining an air flow passageway for receiving compressed air and amplifying its velocity and a compressed air inlet in communication with the air flow passageway, the body member including a main segment and an insert segment for inserting into a container, a cover member disposed over the body member, a spaced distance outwardly of the body member; a plug assembly mounted on the cover member and disposed proximate the body member, the plug assembly closing and opening one end of the passageway of the body member, the plug assembly including a plunger in sliding engagement with the cover member, the plunger having a gripping portion at one end and a valve assembly at an opposite end, the plunger also defining a groove and the cover member including a protrusion that cooperates with the groove to limit the plunger movement along a substantially linear path.

9. The pump apparatus of claim 8, wherein the insert segment of the body member is rotatable relative to the main segment of the body member.

10. The pump apparatus of claim 9, wherein the cover member is releasably secured to the body member by at least one securing member, the securing member extending through the main segment of the body member and into a groove in the insert segment to pivotally connect the main segment to the insert segment.

11. The pump apparatus of claim 10, wherein three securing members releasably secure the cover member to the body member, the three securing members being screws.

12. The pump apparatus of claim 11, wherein the cover member defines an opening for placement in substantial registry with the compressed air inlet of the body member, the opening receiving a fitting of a compressed air conduit, the fitting extending into the inlet of the body member.

13. The pump apparatus of claim 8, further comprising a float assembly secured to the insert segment.

14. In combination with a container having a top plate member that defines an opening, a pump apparatus comprising: a body member defining an air flow passageway for receiving compressed air and amplifying its velocity and a compressed air inlet in communication with the air flow passageway, the body member including a main segment and an insert segment for inserting into a container; a cover member disposed over the body member, a spaced distance outwardly of the body member, the cover member being releasably secured to the body member by at least one securing member, the securing member extending through the main segment of the body member and into a groove in the insert segment to pivotally connect the main segment to the insert segment, the cover member extending proximate the top plate member.

15. The pump apparatus of claim 14, wherein three securing members releasably secure the cover member to the body member, the three securing members being screws.

16. The pump apparatus of claim 15, wherein the cover member defines an opening for placement in substantial registry with the compressed air inlet of the body member, the opening receiving a fitting of a compressed air conduit, the fitting extending into the inlet of the body member.

17. The pump apparatus of claim 14, further comprising a float assembly secured to the insert segment.

18. A pump apparatus powered by compressed air and used to selectively fill and evacuate a container, the pump apparatus comprising:

a body member defining an airflow passageway for receiving compressed air, the body member including a main segment and an insert segment having a first end portion connected to the main segment and a second end portion connected to the container, the first end portion of the insert segment being configured and arranged to allow the main segment to rotate about the insert segment while the second end of portion of the insert segment is securely connected to the container so that the insert segment remains stationary with respect to the container.

19. The pump apparatus of claim 18, wherein the first end portion of the insert segment includes a groove, and wherein a securing member extends through the main segment and into the groove of the insert segment to rotatably connect the main segment to the insert segment.

20. The pump apparatus of claim 19, wherein the groove in the insert segment is an annular groove, and wherein the securing member includes a plurality of securing members.

21. A pump apparatus powered by compressed air and used to selectively fill and evacuate a container, the pump apparatus comprising:

a body member defining an airflow passageway for receiving compressed air and amplifying its velocity and a compressed air inlet in communication with the air flow passageway, the body member including a main segment and an insert segment for insertion into the container; and a cover member disposed over the body member and a spaced distance outwardly of the body member to define a discharge channel between an inner surface of the cover member and an outer surface of the body member, the discharge channel being configured and arranged such that fluid caused to flow out of the discharge channel will be directed towards the container.

22. The pump apparatus of claim 21, wherein the discharge channel substantially surrounds the main segment of the body member.

23. The pump apparatus of claim 21, wherein the pump apparatus is positioned on top of the container, such that the fluid caused to flow out of the discharge channel will be directed towards the top of the container.

24. A pump apparatus powered by compressed air and used to selectively fill and evacuate a container, the pump apparatus comprising:

a body member defining an airflow passageway for receiving compressed air and amplifying its velocity, the body member including a main segment and an insert segment for insertion into the container;

a cover member disposed over the body member; and a plug assembly adapted to close and open one end of the passageway of the body member, the plug assembly including a plunger and a handle at one end thereof, the plunger being adapted to move in and out with respect to the cover member between a first position and a second position, the handle being biased in one direction to locate the plunger in one of the first and second positions, and when the plunger is moved to the other of the first and second positions, the handle being rotatable with respect to the cover member to releasably lock the plunger in the other of the first and second positions.

25. The pump apparatus of claim 24, wherein the plunger includes a groove and the cover member includes a protrusion that cooperates with the groove to limit the movement of the plunger.

26. The pump apparatus of claim 25, wherein the groove of the plunger has a first portion and a second portion which is substantially transverse to the first portion.

* * * * *

UNITED STATES PATENT AND TRADEMARK OFFICE

CERTIFICATE OF CORRECTION

PATENT NO. : 6,537,036 B1 
DATED : March 25, 2003
INVENTOR(S) : Steven Broerman and Aaron V. Monje It is certified that error appears in the above-identified patent and that said Letters Patent is hereby corrected as shown below:

Column 6,
Line 6, delete "2" and substitute therefor -- 1 --
Line 15, delete "2" and substitute therefor -- 1 --

Signed and Sealed this

Sixteenth Day of September, 2003

JAMES E. ROGAN
*Director of the United States Patent and Trademark Office*